US006543375B1

(12) United States Patent
Sargent et al.

(10) Patent No.: US 6,543,375 B1
(45) Date of Patent: Apr. 8, 2003

(54) SOLAR POWERED BOAT LIFT

(75) Inventors: Charles L. Sargent, Bonita Springs, FL (US); Shawn M. McLaughlin, Punta Gorda, FL (US)

(73) Assignee: Quality Boat Lifts, Inc., Fort Myers, FL (US)

( * ) Notice: Subject to any disclaimer, the term of this patent is extended or adjusted under 35 U.S.C. 154(b) by 0 days.

(21) Appl. No.: 10/010,710

(22) Filed: Dec. 5, 2001

(51) Int. Cl.[7] ..... B63C 1/02
(52) U.S. Cl. ..... 114/45
(58) Field of Search ..... 114/44–48; 405/3

(56) References Cited

U.S. PATENT DOCUMENTS 4,492,310 A * 1/1985 Weingart ..... 212/191
4,686,920 A * 8/1987 Thomas ..... 114/48
4,763,592 A * 8/1988 Russ ..... 114/45
5,281,077 A * 1/1994 Phillips ..... 414/678
5,390,616 A * 2/1995 Roth ..... 114/44
5,593,247 A * 1/1997 Endres et al. ..... 405/3
5,908,264 A * 6/1999 Hey ..... 405/3

* cited by examiner

*Primary Examiner*—Ed Swinehart
(74) *Attorney, Agent, or Firm*—William E. Noonan

(57) ABSTRACT

A solar powered boat lift includes a support structure adjacent to the boat to be lifted. There is a platform for accommodating the boat thereon and cables are operably connected to the platform for enabling raising and lowering thereof. A plurality of reversible DC motors are mounted to the support structure and operably connected to the cables for selectively driving the cables longitudinally in a first direction to raise the platform and in an opposite direction to lower the platform. A rechargeable battery is operably connected to each DC motor for providing electrical power to drive the motor. A solar collector is connected to the rechargeable batteries for collecting solar energy and converting such energy to electrical power that is delivered to the rechargeable batteries for recharging thereof. In an alternative embodiment, a single solar rechargeable battery is employed and a power cable is electrically interconnected between the motors and attached to the support structure entirely above the water.

13 Claims, 4 Drawing Sheets

SOLAR POWERED BOAT LIFT

FIELD OF THE INVENTION

This invention relates to a solar powered boat lift and, more particularly, to a lift that features a rechargeable battery associated with each drive motor of the lift.

BACKGROUND OF THE INVENTION

Boat and watercraft lifts are presently operated using either AC or DC power. Where an alternating current outlet is unavailable, a battery operated DC motor is typically used to operate (i.e. raise and lower) the lift.

A boat lift that employs a direct current drive system typically exhibits a number of disadvantages. Such systems require approximately 10 times as much current to run a 12-volt DC motor as is required to run a comparable horsepower motor operating on 110–120 VAC. Transmitting this level of amperage requires the use of a relatively large gauge (e.g. 00 gauge) electrical wire, which is fairly expensive and difficult to install. These problems are compounded when multiple DC motors are employed. Oftentimes, the wiring must be run underwater. Lifts utilizing multiple DC motors on respective longitudinal sides of the lift also tend to experience synchronization problems. These types of motors are very sensitive to voltage drops between the motors. This can cause the motors to run at different speeds. As a result, one side of the lift platform may be raised or lowered at a different speed than the other side. Obviously, this can cause serious problems during the lifting operation.

SUMMARY OF THE INVENTION

It is a therefore an object of this invention to provide a solar powered boat lift that operates on DC power much more efficiently and reliably than pre-existing lifts.

It is a further object of this invention to provide a solar powered boat lift that significantly reduces the need to use expensive, inefficient and difficult to install large gauge electrical wiring on the lift.

It is a further object of this invention to provide a solar powered boat lift that raises and lowers a vessel in a smooth, even and synchronous fashion.

It is a therefore an object of this invention to provide a solar powered boat lift that employs a rechargeable battery in connection with each lifting motor of the boat lift such that large gauge, expensive, difficult to install and inefficient power cables are eliminated.

This invention results from a realization that an improved DC powered boat lift drive may be achieved by connecting a rechargeable battery and associated solar collector with each DC motor of the lift. This eliminates the use of expensive, unwieldy power cables and provides for an improved, synchronous operation. This invention also results from the further realization that a single solar rechargeable battery may be used to energize multiple power heads that are interconnected by a power cable attached to a dock or pier and extending between the power heads entirely above the water.

This invention features a solar powered boat lift including a support structure adjacent to which a boat to be lifted is locatable. There is a platform for accommodating the boat thereon. Cable means are operably connected to the platform for enabling raising and lowering thereof. Reversible DC motor means including at least a pair of reversible DC motors are mounted to the support structure and operably connected to the cable means for selectively driving the cable means longitudinally in a first direction to raise the platform and in an opposite direction to lower the platform. Rechargeable battery means including at least a pair of rechargeable battery assemblies are operably connected to the DC motor means for providing electrical power to drive the motor means. Each rechargeable battery assembly is connected to a respective motor. Solar collecting means are operably connected to the rechargeable battery means for collecting solar energy and converting such energy into electrical power that is deliverable to the rechargeable battery means for recharging thereof.

In a preferred embodiment, the battery means and the solar collector means are mounted to the support structure. The support structure may include a first support piling locatable on a proximal longitudinal side of the boat to be lifted and a second support piling locatable on a distal longitudinal side of the boat. The motor means may include a pair of reversible DC motors, each being mounted to a respective one of the first and second support pilings. The rechargeable battery means may include a pair of rechargeable batteries, each operably connected to a respective one of the motors. The solar collector means may include a pair of solar collectors, each operably connected to a respective rechargeable battery. Alternatively, a single solar collector connected to each battery may be used. A control signal conductor may operably interconnect the motors to synchronize operation thereof. Each rechargeable battery may be mounted on a respective one of the first and second support pilings.

Remote control means may be provided for selectively activating and deactivating the motor means and for selectively directing the motor means to operate in a first direction wherein the platform is raised and in an opposite, second direction where the platform is lowered. The remote control means may include a receiver operably connected to the motor means and a transmitter for directing selected control signals to the receiver, which signals control operation of the motor means. The transmitter and receiver may be adapted for communicating radio signals therebetween.

This invention also features a solar powered boat lift including a support structure, a platform and cables as previously recited. There are a pair of DC motors mounted to the support structure and operably connected to the cables for selectively driving the cables longitudinally in a first direction to raise the platform and in an opposite direction to lower the platform. A power cable electrically connects the motors and is attached to the support structure for extending between the motors entirely above the water. A single rechargeable battery assembly is operably connected to one of the motors and through the power cable to the other motor for providing electrical power to drive the motors. Solar collecting means again are operably connected to the battery for collecting solar energy and converting that energy to electrical power that is delivered to the rechargeable battery assembly for recharging thereof.

The support structure may include a pair of pilings, each supporting a respective DC motor. The support structure may also include a dock that extends between the pilings. The power cable may be attached to and extend along the dock entirely above the water. Remote control means as previously specified may be employed as well in this version.

BRIEF DESCRIPTION OF THE DRAWINGS

Other objects, features and advantages will occur from the following description of preferred embodiments and the accompanying drawings, in which.

Figure 1:
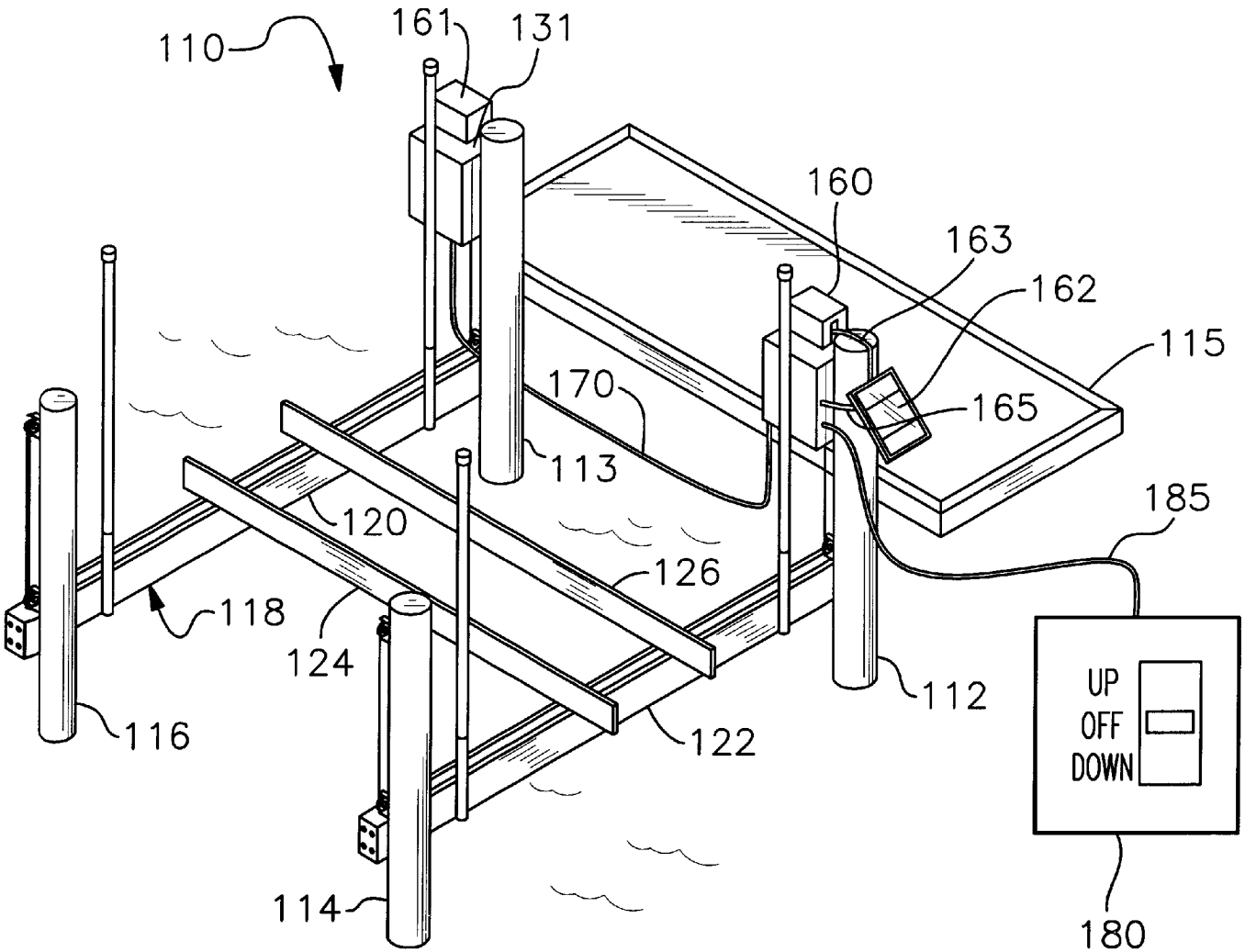
FIG. 1 is a perspective, partly schematic view of a version of a solar powered boat lift employed in the context of a four-piling beamless lift; a respective rechargeable battery is used for each DC motor.

There is shown in FIG. 1, solar powered boat lift 110 comprising a four-piling beamless lift. The solar lift includes a pair of proximal pilings 112 and 113 located on one side of the vessel adjacent a dock, pier or similar structure 115. A second pair of distal pilings 114, and 116 are located on the opposite side of the vessel. A platform 118, comprising a pair of parallel cradle beams 120 and 122 and a transverse pair of bunk boards 124 and 126 connected to the cradle beams, is operably and suspendably supported from the pilings by means of two pairs of lifting cables. See FIG. 6 of copending patent application Ser. No. 09/693,435, filed Oct. 20, 2000, the disclosure of which is incorporated herein by reference.

A pair of DC power heads 130, 131 are respectively mounted by brackets or other suitable means on proximal pilings 112 and 113. Each power head contains a reversible DC motor (not shown), associated winders and reduction means which are constructed and operate in a manner identical or analogous to that shown in copending patent application Ser. No. 09/693,435. One pair of lifting cables are operably engaged with each power head in the manner shown in the above referenced patent application. The power heads operate the cables to raise and lower the platform and supported vessel as required. Various alternative known types of power heads may be employed within the scope of this invention.

Power head 130 is provided with a rechargeable battery assembly 160 including a rechargeable battery and a connected charge controller, which is mounted on power head 130. Similarly, a second rechargeable battery assembly 161 is mounted on power head 131. Each battery assembly 160, 161 is secured to a respective power head 130, 131 by bolts, clamps or other appropriate means. An appropriate conventional electrical connection, not shown, operably interengages the rechargeable battery with the DC motor of the power head. A standard charge controller mechanism is electrically connected to each rechargeable battery. A single solar panel 162 is electrically connected to both rechargeable battery assemblies 160, 161. Solar panel 162 collects solar energy and converts that energy to electricity that is provided over conductor 163 to the rechargeable battery assembly 160. This recharges the battery through the charge controller, which battery in turn powers the motor of power head 130.

A control cable or conduit 170 comprising relatively small gauge recharging and control wires interconnects the respective power heads 130, 131. One of these wires interconnects solar panel 162 to the charge controller of rechargeable battery assembly 161. See wire 165 extending from panel 162 to power head 130. This wire extends through control cable 170 and provides energy to recharge battery assembly 161. This assembly, in turn, powers the motor of power head 131.

The cable also accommodates a separate control wire connected to the motor of power head 131. A control switch 180 electrically connects the DC motor of power head 130 to battery 160 and the motor of power head 131 to battery 161. The control switch is connected to the motor of power head 130 by wiring run through cable 185. Likewise, switch 180 is connected to the motor of power head 131 by wiring run through cables 185 and 170. Significantly, the control wiring in cable 170 is inexpensive and easy-to-install, light gauge wiring. Switch 180 comprises a conventional toggle switch that is alternatable between "up", "down" and "off" positions. When the switch arm is switched into the "up" condition, the motors of respective power heads 130, 131 are powered by their respective batteries 160, 161 and open in a first direction to drive the cables such that they raise the lift platform 118 and a vessel supported thereon. Alternatively, when the switch arm is moved into the "down" position, a signal is provided to each motor which causes the motors to reverse direction and thereby lower the lift platform. Of course, switching the switch arm into the "off" position disconnects power from the DC motors. The control circuit may comprise appropriate switching and relay circuitry which will be known to persons skilled in the art.

Each DC motor is selectively powered by a respective rechargeable battery. That battery is re-energized by electricity supplied from solar panel 162. Because each motor is powered by its own respective rechargeable battery, a heavy gauge power cable is not required to interconnect the motors. Instead, only a light gauge control wire is needed. This eliminates the cost and complexity of handling the heavier gauge power cable, which would be required to supply DC power from a single battery to both motors. At the same, time little or no voltage drop is exhibited across the motors. As a result, a synchronous operation is achieved because each motor is operating at the full voltage provided by its respective battery.

Figure 1A:
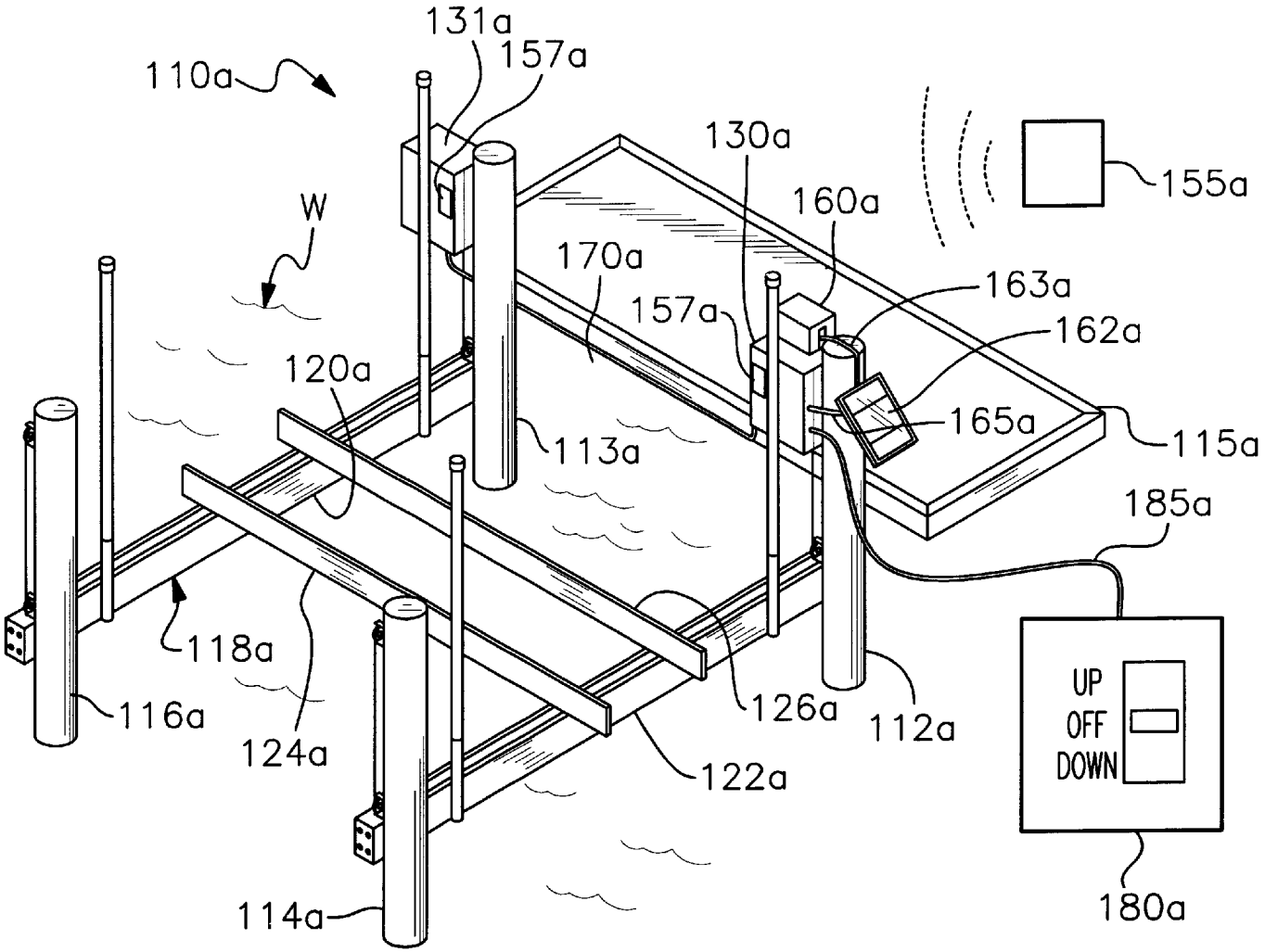
FIG. 1A is a perspective, partly schematic view of an alternative solar powered boat lift employing a single rechargeable battery for energizing pair of lift motors.

There is shown in FIG. 1A an alternative version of the solar powered lift 110*a*. In this embodiment, elements that are analogous to those in the previously described embodiment are assigned corresponding reference numbers accompanied by lower case "a" designations. This version also includes a number of variations from the embodiment of FIG.1.

In particular, lift 110*a* includes only a single rechargeable battery assembly 160*a* that is mounted on and connected to power head 130*a*. In this version, a power cable 170*a* is interconnected between power heads 130*a* and 131*a*. Power cable 170*a* includes a wire having a larger gauge cable than that of control wire 170 shown in FIG. 1. Cable 170*a* is attached to and extends along dock 115*a* between power heads 130*a* and 131*a* such that cable 170*a* is entirely above water W. Appropriate brackets or other known means of attachment are employed. This embodiment is most appropriate for lifts wherein the power heads 130*a* and 131*a* are located approximately 8'–10' apart. As a result, a corresponding limited length of power cable is required. The cable is not submerged so that it is much easier to install and operates more reliably. These factors attenuate the disadvantage of having to use a thicker power cable to electrically interconnect the power heads.

In operation, power is again supplied from battery assembly 160*a* to power heads 130*a* and 131*a* by operating switch

180*a*. A single solar collector 162*a* is connected and provides recharging energy to battery 160*a*. Alternatively, or in addition to switch 180*a*, a radio transmitter 155*a* may be employed to operate power heads 130*a* and 131*a* by remote control. In such versions, each power head is provided with a respective radio receiver 157*a* that receives appropriate radio signals from transmitter 155*a* to either raise or lower the platform. This remote control operation is described more fully below in connection with the embodiment of FIG. 3.

Figure 2:
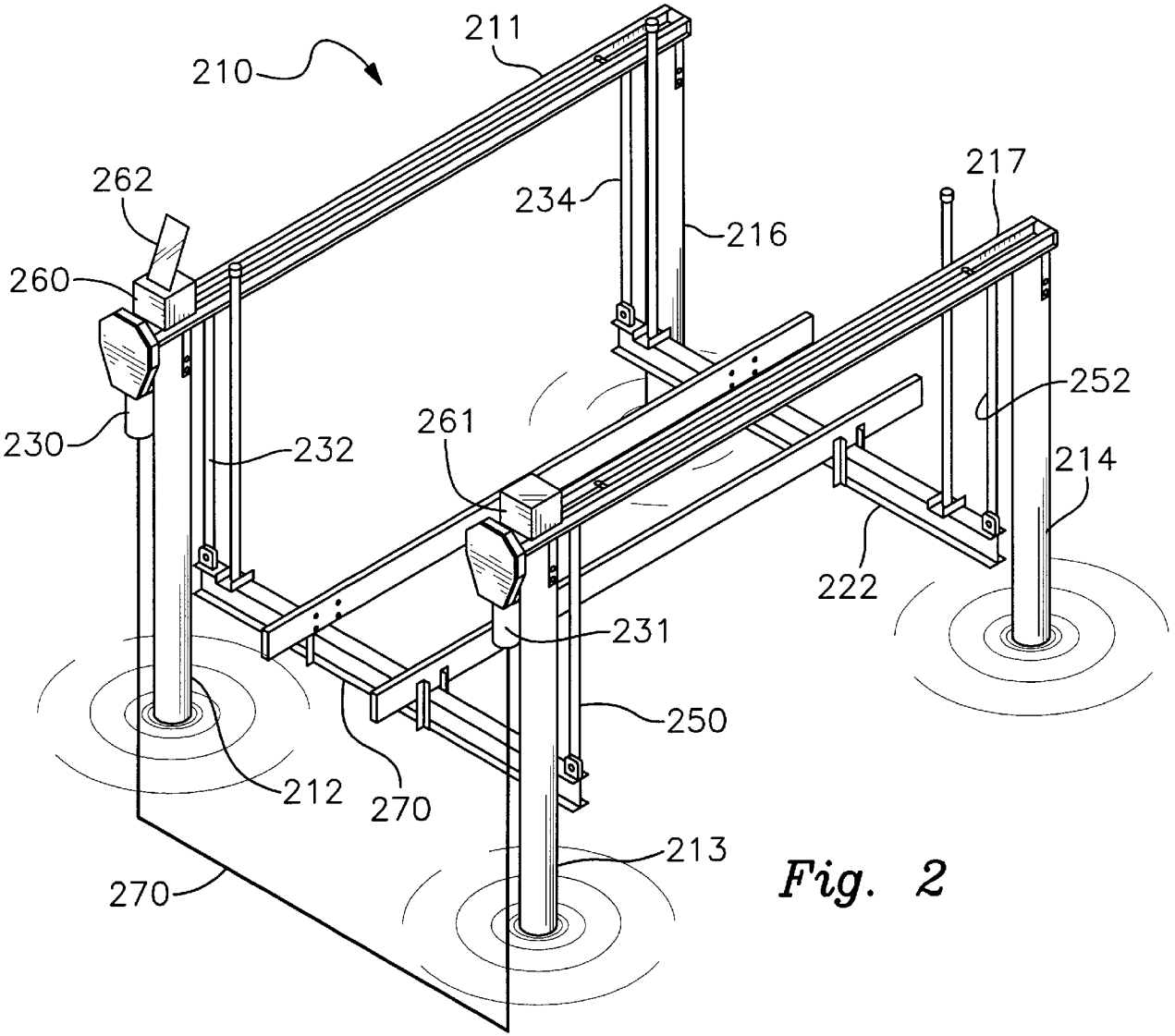
FIG. 2 is a perspective view of an alternative version of the solar powered lift used on a four-piling shafted beam lift and including a light gauge control wire that interconnects DC drive motors mounted on respective longitudinal sides of the lift; a rechargeable battery is mounted on each side of the lift and each battery is connected to a respective motor.

In solar power lift 210 shown in FIG. 2, the lift employs a shafted beam construction. In particular, a pair of cable beams 211 and 217 extend between pilings 212, 216 and 213, 214 respectively. In lift 210, a pair of reversible DC motors 230, 231 are employed on respective longitudinal sides of the lift. Each motor operates, in a well-known manner, associated lifting cables that extend through and depend from respective cable beams 211, 217 for supporting respective ends of cradle beams 220 and 222. For example, motor 230 mounted to piling 212 operates lifting cables 232 and 234 that run through cable beam 211 and are secured to the left-hand ends of cradle beams 220 and 222 respectively. Similarly, the motor 231 mounted to piling 213 operates cables 250 and 252 that are run through beam 217 and secured to the right-hand ends of cradle beams 220 and 222 respectively.

A rechargeable battery assembly 260, 261 is associated with each motor 230, 231 and, in particular, is mounted proximate its associated motor head upon a respective one of the cable beams 211 and 217. A solar panel 262 is mounted on assembly 260 and electrically connected to each rechargeable battery. Wiring for connecting the solar panel to battery assembly 261 extends through cable 270. Each battery provides power selectively to an associated one of the motors 230, 231. Cable 270 further includes a light gauge (⅜ inch) control wire interconnected between the motors.

In operation, an appropriate switch (not shown), which may be similar to the switch previously described, provides operational control signals to motors 230 and selectively activates the motors in either a first direction to raise the platform or in an opposite second direction to lower the platform. Power is provided to the motors by the respective rechargeable batteries. DC voltage is provided directly to each motor from its respective battery and the 12-volt power does not have to be transmitted between the respective motors. Instead, only a low voltage control signal is transmitted between the motors and a low voltage recharging signal is transmitted between the solar panel and the battery. Once again, this greatly facilitates installation of the wiring and reduces expense. Additionally, the motor heads are properly synchronized because there is no voltage drop across the lift between the batteries.

Figure 3:
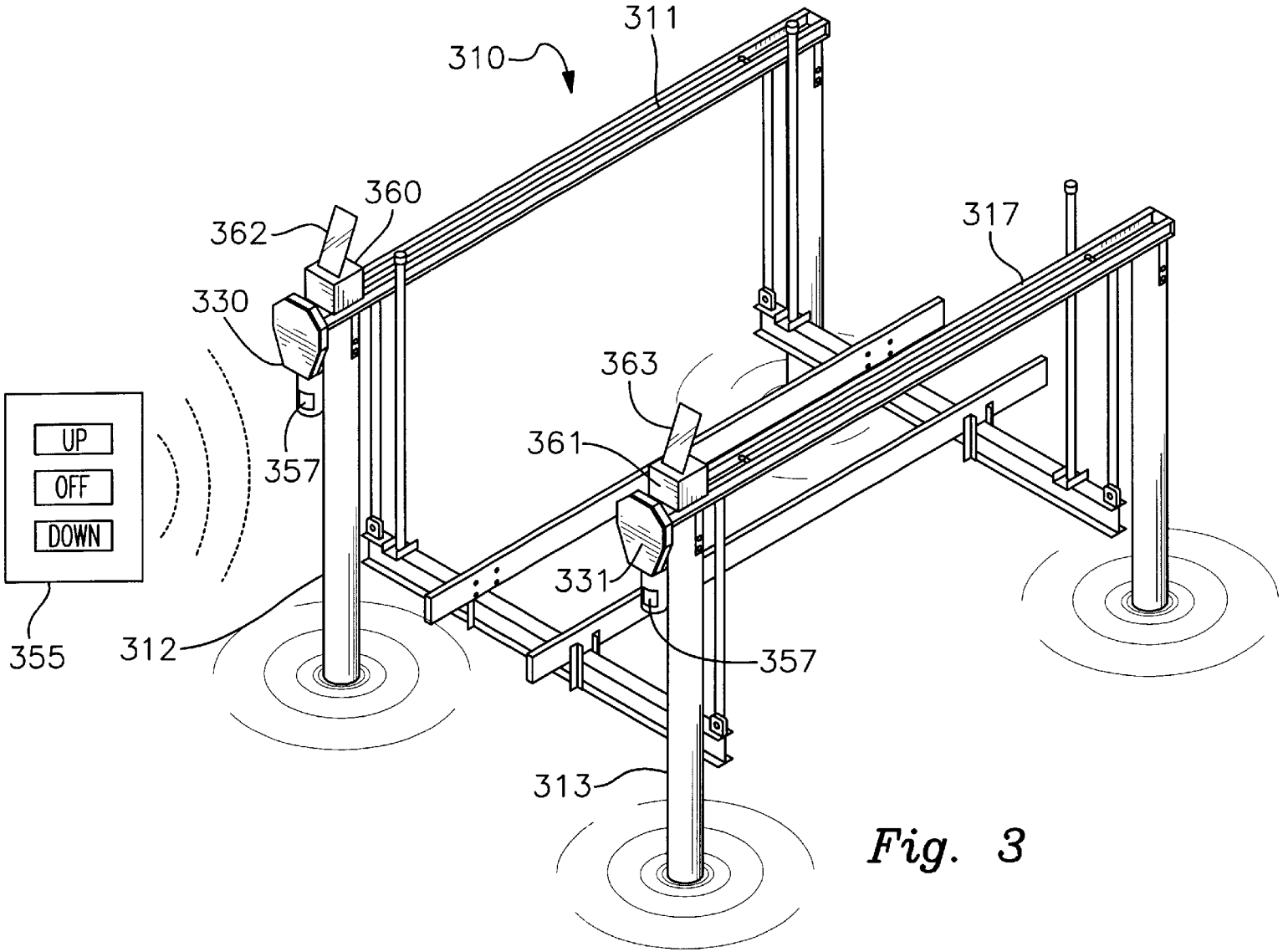
FIG. 3 is a view similar to FIG. 3 depicting a version of the lift wherein wireless radio control signals are used to operate the drive motors.

Still another version of the solar powered lift 310 is shown in FIG. 3. This lift again comprises a shafted cable beam lift employing known power or motor heads 330, 331 on respective sides of the lift. The cable beams, lifting cables and platform assembly are constructed in the manner previously described and in a manner that will be known to persons skilled in the art. As in the prior embodiments, each motor head is secured to one of the proximal pilings 312 and 313.

A rechargeable battery assembly 360, 361 and an associated solar collector 362, 363 are mounted on each of the cable beams 311, 317. Each battery and its associated solar panel provides power to respective one of the motor heads 330, 331 and is electrically connected thereto in a conventional manner. It should be understood that, alternatively, a single solar panel may be employed to recharge both batteries. In that case, a light gauge recharging wire is connected between the solar panel and the remote battery. It should also be understood that in the version shown in FIGS. 1 and 2 a separate solar collector may be connected to each battery such that the recharging wire across the lift is eliminated.

In the version of FIG. 3, a control signal is provided to each motor head 330, 331 by means of the wireless radio transmitter 355. Each motor head is equipped with a respective radio receiver 357. Appropriate switches are provided on transmitter 355 for directing "up", "down" and "off" signals to receivers 357. Upon receipt of such signals, the receivers convert the radio signals into representative electrical signals that direct the motor heads to either raise or lower the plafform or to stop motion of the lift, as required.

This embodiment eliminates all wiring between the respective motor heads 330, 331. As a result, installation is facilitated and malfunctions caused by running the wiring beneath the water are reduced significantly. Each motor head receives power from a respective rechargeable battery assembly and its associated solar panel. This, in combination with the use of wireless radio control signals eliminates the need for wiring between the respective motor heads entirely. As a result, the cost of installation is reduced. Once again, an improved, smooth, even and reliable synchronous operation is achieved. The wireless radio controlled motor may be employed in either of the embodiments of this invention.

From the foregoing it may be seen that the apparatus of this invention provides for a solar powered boat lift and, more particularly, to a lift that features a rechargeable battery associated with each drive motor of the lift. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A solar powered boat lift comprising:

a support structure adjacent to which a boat to be lifted is locatable, said support structure including a first support component locatable on a proximal longitudinal side of the boat to be lifted and a second support component locatable on a distal longitudinal side of the boat;

a platform for accommodating the boat thereon;

a plurality of cables operably connected to said platform for enabling raising and lowering thereof;

a pair of reversible DC motors, each mounted to a respective one of said first and second support components and operably connected to said cables for selectively driving said cables longitudinally in a first direction to raise said platform and in an opposite direction to lower said platform;

a pair of rechargeable batteries, each operably connected to a respective one of said motors for providing electrical power to drive said motor;

at least one solar collector operably connected to said rechargeable battery assemblies for collecting solar energy and converting such energy to electrical power that is delivered to said rechargeable battery assemblies for recharging thereof; and a control signal conductor operably interconnecting the DC motors to synchronize operation thereof.

2. The lift of claim 1 in which said battery assemblies are mounted to said support structure.

3. The lift of claim 1 in which each said solar collector is mounted to said support structure.

4. The lift of claim 1 in which said solar collector means include a single solar panel mounted on one of said first and second support components and a pair of recharging conductors each interconnected between said panel and a respective one of said rechargeable battery assemblies.

5. The lift of claim 4 further including an electrical cable extending between said first and second support components for accommodating said control signal conductor and one of said recharging conductors.

6. The lift of claim 1 in which each said rechargeable battery is mounted on a respective one of said first and second support components.

7. A solar powered boat lift comprising:

a support structure adjacent to which a boat to be lifted is locatable, said support structure including a first support component locatable on a proximal longitudinal side of the boat to be lifted and a second support component locatable on a distal longitudinal side of the boat;

a platform for accommodating the boat thereon;

a plurality of cables operably connected to said platform for enabling raising and lowering thereof;

a pair of reversible DC motors, each being mounted to one of said first and second support components and operably connected to said cables for selectively driving said cables longitudinally in a first direction to raise said platform and in an opposite direction to lower said platform;

a pair of rechargeable batteries, each operably connected to a respective one of said motors;

a pair of solar collectors, each operably connected to a respective one of said rechargeable battery assemblies for collecting solar energy and converting such energy to electrical power that is delivered to said rechargeable battery assemblies for recharging thereof; and a remote control system for selectively activating and deactivating said DC motors and for selectively directing said motors to operate in a first direction when said platform is raised and in an opposite, second direction wherein said platform is lowered, said remote control system including a pair of receivers, each operably connected to a respective one of said motors and a transmitter for directing selected control signals to said receiver, which signals control operation of said motors.

8. A solar powered boat lift for use in combination with a support structure adjacent to which a boat to be lifted is locatable, said boat lift comprising:

a platform for accommodating a boat thereon;

a plurality of cables operably connected to said platform for enabling raising and lowering thereof;

a pair of synchronously controlled, reversible DC motors mounted to said support structure and being operably connected to said cables for selectively driving said cables longitudinally in a first direction to raise said platform and in an opposite direction to lower said platform;

a pair of rechargeable battery assemblies, each operably connected to a respective one of said DC motors for providing electrical power to drive said motor; and at least one solar collector operably connected to said rechargeable battery assemblies for collecting solar energy and converting such energy to electrical power that is delivered to said rechargeable battery assemblies for recharging thereof.

9. The lift of claim 8 further including a control signal conductor that operably interconnects said motors to synchronize operation thereof.

10. The lift of claim 9 in which at least one said solar collector includes a single solar panel mounted on said support structure and a pair of recharging conductors, each interconnected between said panel and a respective one of said rechargeable battery assemblies.

11. The lift of claim 10 further including an electrical cable extending between said motors for accommodating said control signal conductor and one of said recharging conductors.

12. The lift of claim 8 further including a remote control system for selectively activating and deactivating said DC motors and selectively directing said motors to operate in a first direction wherein said platform is raised and in an opposite, second direction wherein said platform is lowered, said remote control system including a pair of receivers, each operably connected to the respective one of said DC motors, and a transmitter for directing selected control signals to said receivers, which signals synchronously control operation of said motors.

13. The lift of claim 8 including a pair of solar panels, each operably connected to a respective one of said rechargeable battery assemblies for providing solar power thereto.

* * * * *